US010745084B2

(12) United States Patent
Forrest et al.

(10) Patent No.: US 10,745,084 B2
(45) Date of Patent: Aug. 18, 2020

(54) SYSTEM AND METHOD FOR ENHANCING A WAKE PROFILE FOR PONTOON BOATS

(71) Applicant: Avalon & Tahoe MFG., Inc., Alma, MI (US)

(72) Inventors: Kris Douglas Forrest, San Martin, CA (US); Duane Nicholas Dinninger, Rockford, MI (US); Greg Ryan Boyd, Coral, MI (US)

(73) Assignee: Avalon & Tahoe Mfg. Inc., Alma, MI (US)

( * ) Notice: Subject to any disclaimer, the term of this patent is extended or adjusted under 35 U.S.C. 154(b) by 0 days.

(21) Appl. No.: 16/243,838

(22) Filed: Jan. 9, 2019

(65) Prior Publication Data

US 2019/0210694 A1 Jul. 11, 2019

Related U.S. Application Data

(60) Provisional application No. 62/615,614, filed on Jan. 10, 2018.

(51) Int. Cl.

| | |
|---|---|
| ***B63B 1/30*** | (2006.01) |
| ***B63B 1/26*** | (2006.01) |
| ***B63B 35/38*** | (2006.01) |
| ***B63B 1/32*** | (2006.01) |
| *B63B 34/70* | (2020.01) |

(52) U.S. Cl.

CPC ..... *B63B 1/30* (2013.01); *B63B 1/26* (2013.01); *B63B 1/32* (2013.01); *B63B 35/38* (2013.01); *B63B 34/70* (2020.02); *B63B 2001/325* (2013.01)

(58) Field of Classification Search

CPC .. B63B 1/00; B63B 1/12; B63B 1/121; B63B 1/20; B63B 1/22; B63B 1/24; B63B 1/26; B63B 1/28; B63B 1/30; B63B 35/00; B63B 35/34; B63B 35/38

USPC ..... 114/61.1, 280, 284, 285, 292

See application file for complete search history.

(56) References Cited

U.S. PATENT DOCUMENTS

| | | | |
|---|---|---|---|
| 5,549,071 | A | 8/1996 | Pigeon et al. |
| 5,664,910 | A | 9/1997 | Lochtefeld et al. |
| 5,787,835 | A | 8/1998 | Remnant |
| 5,860,384 | A | 1/1999 | Castillo |
| 5,860,766 | A | 1/1999 | Lochtefeld et al. |

(Continued)

FOREIGN PATENT DOCUMENTS

WO 2017181237 A1 10/2017

*Primary Examiner* — Lars A Olson

(74) *Attorney, Agent, or Firm* — Robert L. Stearns; Dickinson Wright, PLLC

(57) ABSTRACT

A system for enhancing a wake profile produced by a pontoon boat is provided. The system includes a pair of ramps attached to the bottom of a platform supported by at least two pontoons. The ramps may be oriented downward with a rear end of the ramp disposed in the water between the pontoons. The water flowing between the pontoons is displaced downward by the ramps, thereby increasing water displacement and directing the water to produce an improved wake profile. Downforce may be applied to the boat by one or more wake plates, with a faceted portion of the wake plate facing forward and upward, such that when water impacts the faceted portion a downforce is provided. The wake plates may be attached to the ramps or may be separate from the ramps.

31 Claims, 11 Drawing Sheets

(56) References Cited

U.S. PATENT DOCUMENTS 5,911,187 A * 6/1999 Sohm ..... B63B 1/12 114/61.1
5,911,190 A 6/1999 Lochtefeld et al.
6,012,408 A 1/2000 Castillo
6,047,657 A 4/2000 Cox
6,105,527 A 8/2000 Lochtefeld et al.
6,158,375 A 12/2000 Stuart, Jr.
6,234,099 B1 5/2001 Jessen et al.
6,427,616 B1 8/2002 Hagen
6,874,441 B2 4/2005 Pigeon
6,941,884 B2 9/2005 Moore
6,953,002 B2 10/2005 Jessen et al.
7,063,031 B2 6/2006 Earl, Jr. et al.
7,070,468 B2 * 7/2006 Schmidt ..... B63B 1/107 114/61.12
7,140,318 B1 11/2006 Gasper
7,252,047 B1 8/2007 Baucom, Jr.
7,434,531 B1 10/2008 Zsido et al.
7,707,956 B2 5/2010 Moore
8,191,493 B2 6/2012 Baywol
8,336,477 B2 12/2012 Walker
8,534,214 B1 9/2013 Gasper
8,539,897 B1 9/2013 Gasper et al.
8,578,873 B2 11/2013 Gasper et al.
8,739,723 B1 6/2014 Murphy
8,798,825 B1 8/2014 Hartman
8,833,286 B1 9/2014 Sheedy et al.
8,857,356 B1 10/2014 Murphy
8,955,452 B1 * 2/2015 Wilson ..... B63B 1/12 114/292
8,967,070 B2 3/2015 Kalil
9,038,560 B1 5/2015 Brendel
D730,801 S 6/2015 Herzberger
9,045,204 B1 6/2015 Murphy
9,067,644 B2 6/2015 Sheedy et al.
9,120,535 B1 9/2015 Remnant
9,144,727 B2 9/2015 Lochtefeld
9,150,289 B1 10/2015 Brendel
9,150,291 B2 10/2015 Dollar
9,174,703 B2 11/2015 Sheedy et al.
9,180,932 B2 11/2015 Murphy
9,199,695 B2 12/2015 Gasper et al.
9,260,161 B2 2/2016 Gasper et al.
9,272,762 B1 3/2016 Murphy
9,296,447 B1 3/2016 Morgan et al.
9,315,235 B1 4/2016 Wood
9,315,236 B2 4/2016 Gasper
9,334,022 B2 5/2016 Gasper et al.
9,394,032 B1 7/2016 Pigeon
9,422,028 B2 8/2016 Wilhelm
9,446,823 B2 9/2016 Sheedy et al.
9,493,213 B2 11/2016 Thomas
9,505,464 B1 11/2016 Wood
9,540,074 B1 1/2017 Pigeon
9,545,977 B1 1/2017 Swiatek
9,550,551 B2 1/2017 Swiatek
9,573,655 B1 2/2017 Pigeon
9,580,147 B2 2/2017 Gasper et al.
9,604,700 B2 3/2017 Naples
9,643,697 B2 5/2017 Sheedy et al.
9,689,395 B2 6/2017 Hartman
9,694,873 B2 7/2017 Gasper et al.
9,701,373 B1 7/2017 Murphy
9,708,031 B1 7/2017 Miller et al.
9,796,451 B2 10/2017 Brendel
9,802,684 B2 10/2017 Sheedy et al.
9,828,075 B1 11/2017 Hartman
9,834,280 B1 12/2017 Wilmoth, III et al.
9,855,995 B2 1/2018 Fafard et al.
9,862,457 B2 1/2018 Pigeon
9,873,491 B2 1/2018 Hartman
9,889,909 B2 2/2018 Morgan et al.
9,891,620 B2 2/2018 Green et al.
9,914,503 B2 3/2018 Huyge et al.
9,914,504 B2 3/2018 Gasper et al.
9,914,509 B1 3/2018 Tegeder
9,937,984 B2 4/2018 Herrington et al.
9,950,771 B1 4/2018 Hartman et al.
9,969,464 B1 5/2018 Miller et al.
9,988,126 B2 6/2018 Wood
10,040,522 B1 8/2018 Hartman et al.
10,059,404 B2 8/2018 Clover et al.
2011/0132251 A1 * 6/2011 Wilson ..... B63B 1/12 114/292
2014/0137787 A1 5/2014 Gasper et al.
2016/0207592 A1 7/2016 Decker
2017/0217544 A1 8/2017 Sheedy et al.
2017/0320552 A1 11/2017 Taylor
2018/0037305 A1 2/2018 Sheedy et al.
2018/0079468 A1 3/2018 Fafard et al.
2018/0154988 A1 6/2018 Swift et al.
2018/0208280 A1 7/2018 Minger
2018/0281906 A1 10/2018 Forrest
2018/0284762 A1 10/2018 Green et al.

* cited by examiner

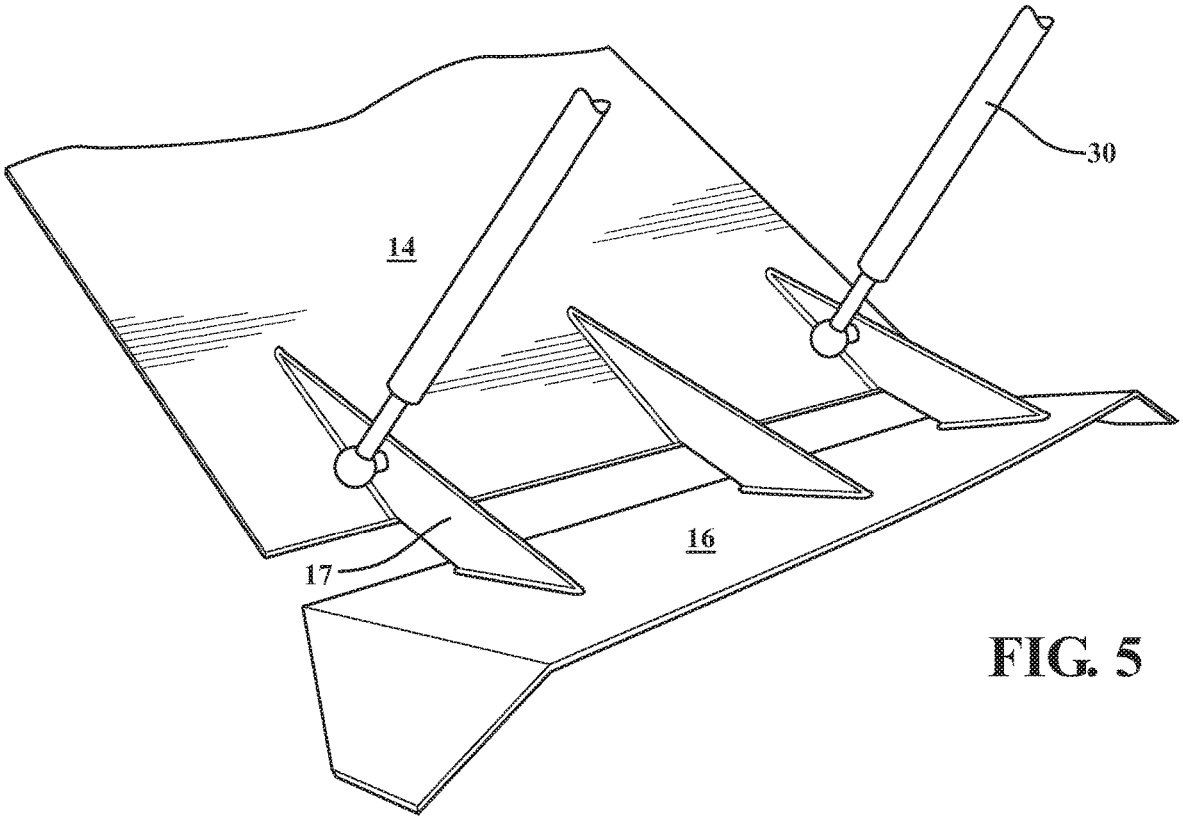
FIG. 5
FIG. 6
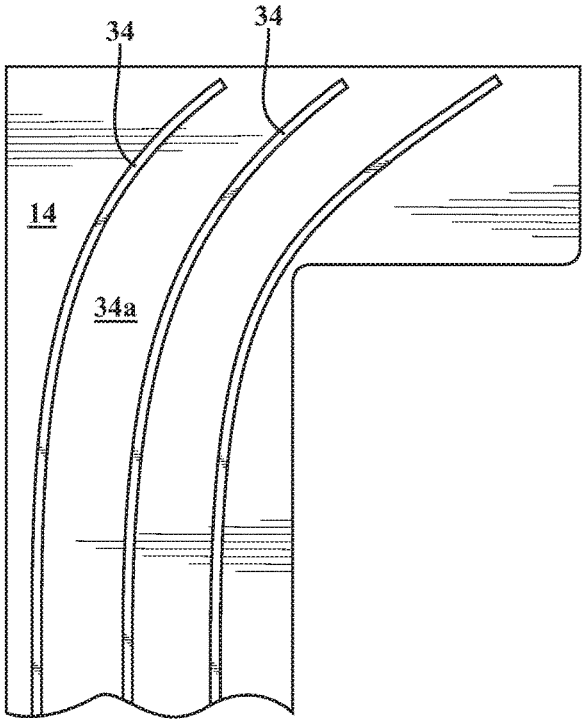

FIG. 7A
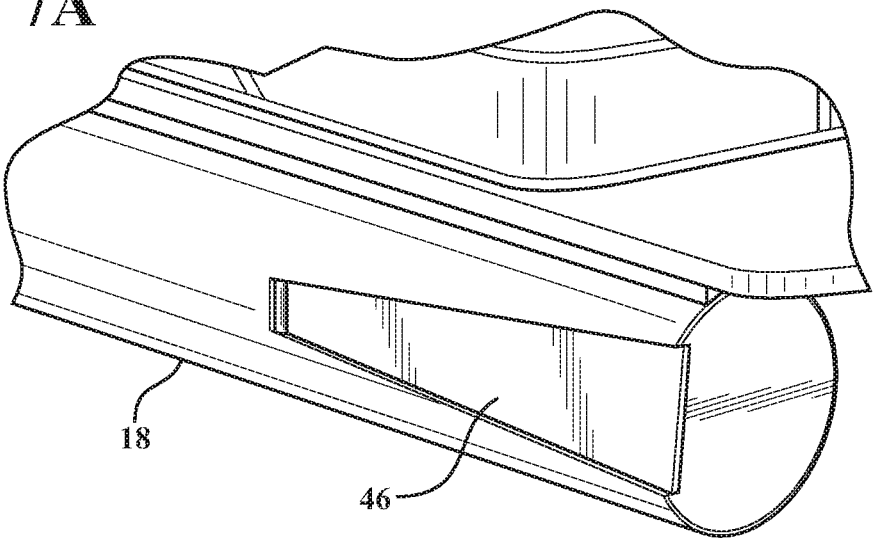
FIG. 7B
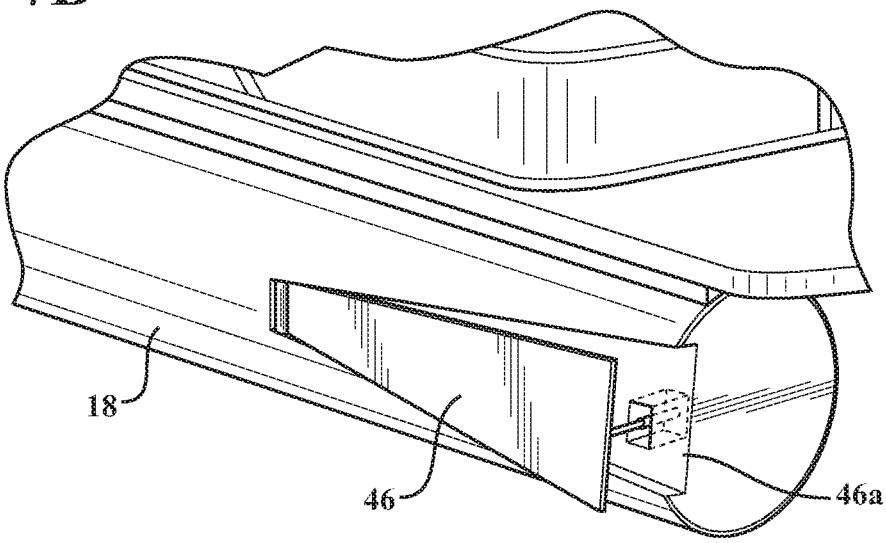
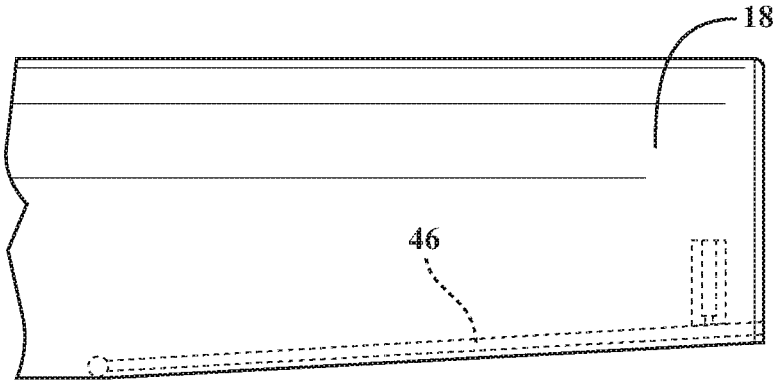
FIG. 7C

SYSTEM AND METHOD FOR ENHANCING A WAKE PROFILE FOR PONTOON BOATS

CROSS-REFERENCE TO RELATED APPLICATIONS

This application claims the benefit of and priority to U.S. Provisional Patent Application Ser. No. 62/615,614, filed Jan. 10, 2018, the entire content of which is hereby incorporated by reference in its entirety.

FIELD OF THE INVENTION

The present disclosure relates to marine wake enhancement systems. More particularly, the present disclosure relates to a system for producing a wake pattern from pontoon boats for providing a surfable wake for wake surfing, wake boarding, and towable devices.

BACKGROUND

Recreational marine vessels are in common use and include a variety of boat types directed to different recreational activities. For example, there are recreational boats tailored for speed and for towing a water-skier or for towing an inflatable device at a generally high speed. Another type of boat is a wake-boat or wake creating boat, that has a specific hull and transom shape that produces a surfable wake behind the boat, allowing for wake surfing or wake boarding, in which a user is towed behind the boat, similar to a speed boat, and the wake boarder or wake surfer may direct themselves toward the wake pattern created by the boat. Wake boats typically operate at a slower speed than a speedboat that tows a water skier.

Pontoon boats are in common use as a leisure boat or pleasure craft capable of carrying a relatively large number of passengers. Pontoon boats may travel at various speeds, but are often utilized at slower speeds, such as cruising speeds, where the passengers may enjoy a relatively stable boat position at a variety of speeds. Pontoon boats may include multiple pontoons that float on the water, with the pontoons supporting a platform on which the passengers are carried. Unlike a traditional boat hull, the pontoons will define an open area laterally between them, with the platform supported on top of the pontoons and above the open area.

Pontoon boats may be utilized at higher speeds and may be able to operate to tow an inflatable or other similar device behind the boat, but are typically less efficient that other watercraft.

Accordingly, there are different boat styles directed to different types of recreational activity. Due to expense and/or storage limitations, consumers may typically choose a boat style directed to their primary recreational activity. However, in choosing such a boat style, consumers may be limited in other types of recreational activity. In some cases, a consumer may have to purchase more than one type of boat in order to be able to enjoy all of the recreational activities that they desire. For example, a consumer may desire the more relaxed recreational benefits of a pontoon boat, but may also desire the benefits of a speed boat or wake boat to enable wake surfing or water skiing. In this case, the consumer is forced to purchase more than one boat or is forced to compromise on the type of boat they choose, foregoing the benefits of another boat style.

Pontoon boats are particularly popular in that they provide many recreational benefits and are capable of carrying a large number of passengers, which is desirable in many social settings. However, the wake pattern provided by the traditional pontoon boat is unsatisfactory for users interested in wake surfing or wake boarding, because the wake pattern is inconsistent and generally small.

A desirable wake characteristic for wake surfing and wakeboarding includes the shape, the height, and energy of the wake pattern that is created. A wake boat can produce a large wake pattern, both in shape and height, enabling a maximization of tricks and other maneuvers that can be performed. Pontoon boats are typically designed to produce small wakes, which are undesirable for wake boarding or wake surfing enthusiasts. Additionally, pontoon boats do not include a transom like wake boats.

In view of the above, improvements can be made to recreational marine vessels.

SUMMARY

In one aspect, a wake enhancement system for a pontoon boat is provided. The system includes a pair of ramps, including a first ramp and a second ramp, each ramp being moveable between a first position and a second position, the ramps having a ramp body extending between a front end and a rear end, wherein the ramps are configured to provide directional ducting. In the first position, the ramp body extends at a first angle relative to a horizontal direction. In the second position, the ramp body extends at a second angle relative to the horizontal direction, wherein the second angle is greater than the first angle and the rear end is below the front end.

The system may further include a wake plate associated with each of the ramps and disposed rearwardly relative to each of the ramps in a first position of the wake plate. The wake plate includes a faceted portion having an upper surface and a lower surface extending between a front edge and a rear edge and defining an angle of inclination of the wake plate. In the first position of the wake plate, the front edge is disposed below the rear edge and the front surface faces forward and upward.

The ramps are configured to displace water downward when the ramps are in the second position, and the wake plate is configured to provide a downforce and wake curl when the wake plate is in the first position.

In another aspect, a pontoon boat having enhanced wake-creating ability is provided. The boat includes at least two pontoons extending in a longitudinal direction and at least one platform attached to and supported by the pontoons at a position above the surface of the water in operation, the platform having a front end and a rear end.

The boat includes a pair of ramps having a ramp body with a first end pivotably attached to the platform and a second end moveable between a first position and a second position, wherein the second position is below the first position. The first end of the ramp body is disposed at a middle portion of the platform between the first and second ends thereof, and the second end of the ramp body is disposed below a rear portion of the platform. In the second position, water flowing inboard of the pontoons is displaced downward by the ramps.

In another aspect, a method of enhancing a wake pattern produced by a pontoon boat is provided. The method includes conveying a pontoon boat in a forward direction, the pontoon boat having at least two pontoons, including a first pontoon and a second pontoon, the pontoons supporting a platform and defining a first wake profile. The method further includes displacing water into an area between the at least two pontoons and defining a displaced water flow.

The method further includes positioning a pair of ramps, including a first ramp and a second ramp, at an oblique angle relative to the platform and positioning the ramps into the displaced water flow and directing the displaced water flow downward. The method also includes providing a downforce on the pontoon boat to counteract an upward force received by the ramps. The method further includes defining a second wake profile in response to positioning the ramps at an oblique angle, wherein the second wake profile is higher than the first wake profile.

BRIEF DESCRIPTION OF THE DRAWINGS

FIG. 5 is a fragmentary perspective view of another aspect of the ramp and wake plate, where the wake plate is attached directly to the ramp;

FIG. 6 is a bottom view of an aspect of the ramp with longitudinally extending ribs;

FIGS. 7A-7C illustrate an outer flap mechanism on the outboard surface of the pontoon;

DETAILED DESCRIPTION

Figure 1A:
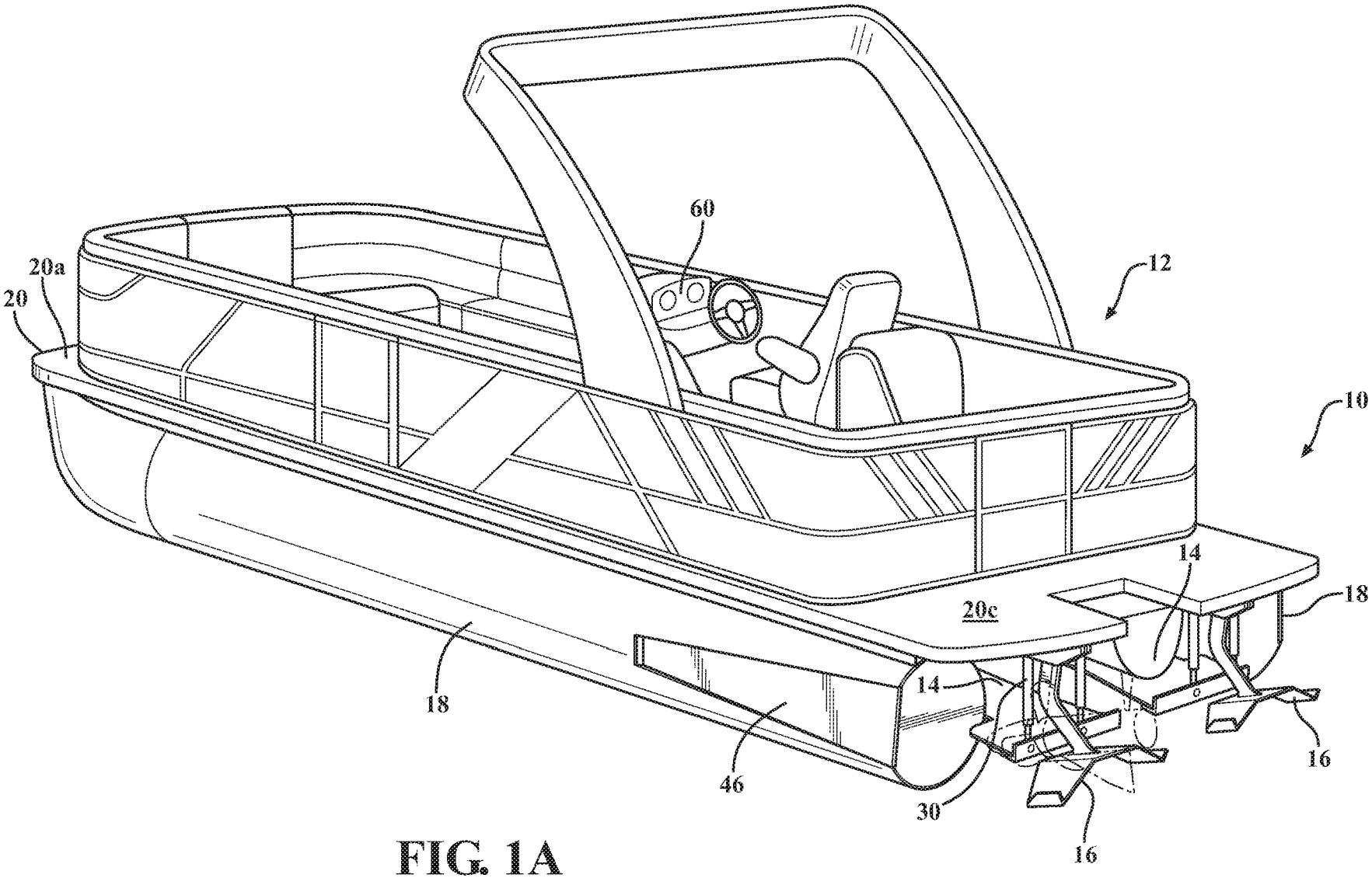
FIG. 1A is a perspective view of a pontoon boat having actuatable directional ducting ramps and trailing wake plates disposed laterally between the pontoons.

With reference to the FIGS. 1 and 2, a wake enhancement system 10 for a boat 12, in particular a pontoon boat, is provided. The system 10 may include the boat 12, a pair of ramps 14 for directional ducting (DD) with associated mechanisms, and a pair of wake plates 16 and associated mechanisms. For purposes of discussion, the ramps 14 and wake plates 16 and their associated mechanisms may be described with reference to one of the ramps 14 and/or wake plates 16, unless otherwise noted. The ramps 14 may also be referred to as DD ramps 14 to more clearly describe the directional ducting function provided by the ramps 14. The DD ramps 14 and wake plates 16 may be coupled to structure of the boat 12, as further described below.

The DD ramps 14 may be provided as a pair, as described above, and may be independently actuatable and positioned relative to each other and the boat 12. Put another way, one of the DD ramps 14 may be actuated to a different position relative to the boat 12 than the other of the DD ramps 14. Thus, one of the DD ramps 14 could be positioned higher or lower than the other DD ramp 14. However, it will be appreciated that the DD ramps 14 could be also be actuated to the same height. The DD ramp 14 is coupled to a bottom surface of the boat 12, and is preferably actuatable via an associated mechanism relative to fixed structure of the boat 12. The wake plate 16 may be coupled to the structure of the boat 12, or alternatively, to the structure of the DD ramp 14. The DD ramp 14 and the wake plate 16 enhance the wake generated by the boat 12 to shape the resulting wake and produce an enhanced wake pattern and wake characteristic sufficient for wake boarding or wake surfing. As further described below, the wake plate 16 may be separately mounted to the boat 12, or may be mounted to the DD ramp 14. However, in some approaches, the system 10 may optionally operate without a wake plate for additional enhancements.

With reference to FIGS. 1A-2B, turning now to the boat 12, the boat 12 may include at least two pontoons 18, and in some cases may include three pontoons 18, that are spaced apart laterally and extend longitudinally relative to a longitudinal direction of the boat 12. The boat 12 further includes a platform 20 supported by the pontoons 18 off the surface of the water along which the boat 12 travels in use, with the platform 20 being fixed to the pontoons 20 in a traditional manner known in the art, such as by welding, bolting, strapping, or the like. The platform 20 provides a structure for mounting additional boat structure, such as benches or other seating, storage compartments, boat controls, or the like that may be typically disposed on a recreational boat.

The platform 20 includes an upper surface 20*a* and a lower surface 20*b*. The upper surface 20*a* is typically the surface on which the passengers of the boat will sit or stand, and the lower surface 20*b* faces the water. The lower surface 20*b* and the pontoons 18 thereby define an open space 22 above the surface of the water that extends below the platform 20 and between the pontoons 18 when the boat 12 is floating on the water.

As described above, the boat 12 may include at least two pontoons 18, where the pontoons 18 will be disposed generally laterally symmetrical relative to a longitudinal centerline of the boat 12. In one aspect, the boat 12 may include a third pontoon 18*a* disposed generally along the longitudinal centerline of the boat 12. In this approach, a pair of open spaces 22 are disposed between the third pontoon 18*a* and the laterally outboard pontoons 18.

The open space(s) 22 may also be referred to as a channel or channels, which is where the DD ramps 14 are disposed. The DD ramps 14 may therefore channel or direct water along their lengths in a duct-like manner. In the case of three pontoons 18, the pontoons 18 may operate to help channel the water along the DD ramps 14.

In one approach, the pontoons 18 may resemble traditional pontoons in that the pontoons 18 have an elongate shape with a generally circular cross-section and a diameter. The pontoons 18 may be generally hollow, thereby providing buoyancy when disposed in the water and allowing the boat 12 to float. As further described below, the pontoons 18 may have additional shape characteristics, such as shapes that are not circular in cross-section or having different trailing end profiles. In a traditional pontoon shape, the leading edge of the pontoon may be tapered to decrease resistance when the boat is being propelled through the water. The trailing end of the pontoon 18 may be generally blunt or may have a slight curvature to reduce drag.

Traditional pontoon boats are designed to produce reduced resistance in the water such that the pontoons 18 will float high on the surface of the water, thereby displacing a smaller or minimal amount of water. As passengers are added to the pontoon boat, the weight thereby increases, displacing an additional amount of water. Increasing the water displacement will increase the wake produced by the pontoon boat. However, the wake produced is typically very unorganized and turbulent around the pontoons. During operation of the traditional pontoon boat, a non-organized wake is produced within the channel between the pontoons as well as behind the pontoons. Typically, it is desirable to reduce water displacement, drag, and wake produced by a pontoon boat, such that the boat may be more energy efficient and require less power to propel the boat through the water. In the present improved system 10, wake and drag may be desirable, and the system 10 will produce an increased amount of water displacement, wake, and drag, which is the opposite of a traditional pontoon boat.

Figure 2A:
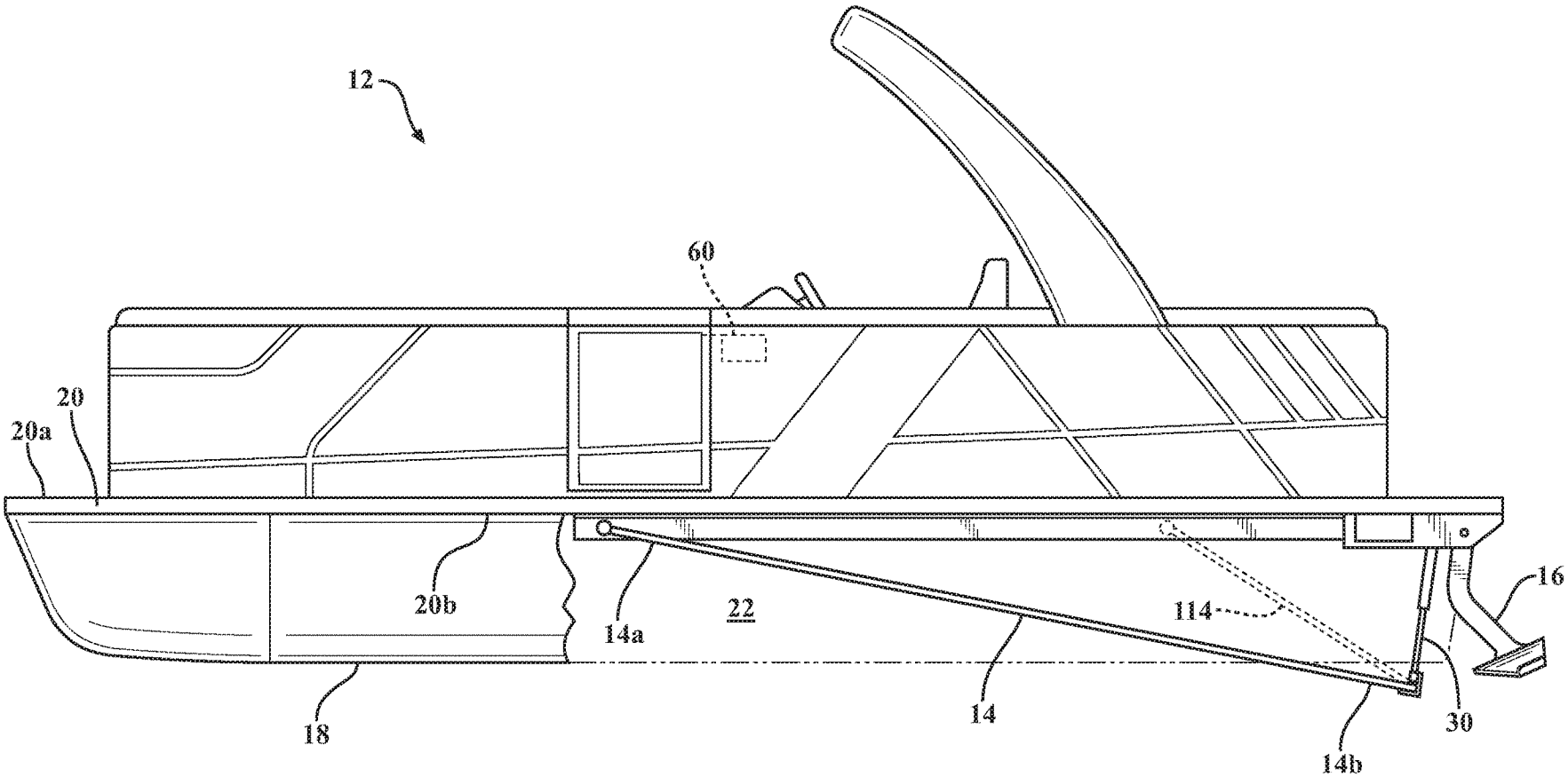
FIG. 2A is a side view of the boat, illustrating the ramps and wake plates in an extended position.
Figure 2B:
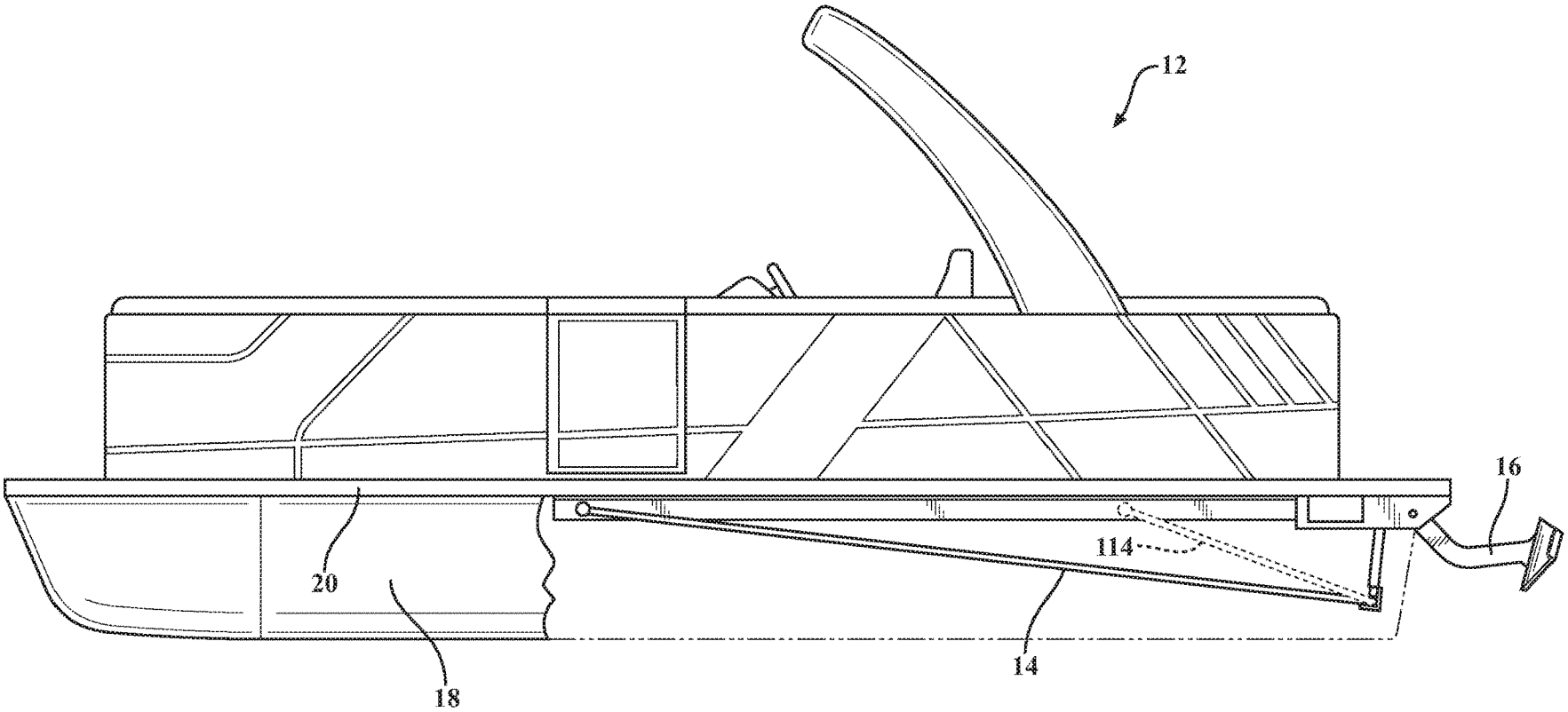
FIG. 2B is a side view of the boat, illustrating the ramps and wake plates in a stowed position.

In the present improved system 10, the system 10 operates to control and organize the wake produced by the pontoon boat 12, and in particular the wake produced between the pontoons 18. As described above, the system includes the pair of DD ramps 14. The DD ramp 14 may be in the form of an elongated panel, plate, sheet, plank, board, or the like, which is attached to a forward pivot point located under the platform 20, such that the DD ramp 14 extends rearward from the pivot point. FIGS. 2A and 2B illustrate a side view of the DD ramp 14. FIG. 2A illustrates a long version of the DD ramp 14, and also an alternative short version 114, which may operate similarly to the DD ramp 14 described herein, with the difference being the location of the pivot point, which is further rearward relative to the DD ramp 14 illustrated throughout the other figures.

As described above, the DD ramp 14 may be attached to the lower surface 20*b* of the platform 20 and between the pontoons 18. Put another way, the DD ramp 14 is disposed in the open space(s) or channel(s) 22 that are defined between the pontoons 18. The DD ramp 14 may include a first end 14*a* and a second end 14*a*. The first end 14*a* may be the forward end and the second end 14*b* may be the rearward end, relative to the forward direction of travel for the boat 12.

As shown in FIGS. 2A and 2B, the first end 14*a* of the DD ramp 14 may be attached to the platform 20 in a pivotable manner, via a hinge mechanism or pin mechanism or other mechanism allowing the DD ramp 14 to remain engaged with the platform 20 through a variety of angular orientations. FIG. 2A shows the DD ramp 14 in an extended downward position and increased angular position relative to a stowed position shown in FIG. 2B.

The second end 14*b* of the DD ramp 14 is configured to move upward and downward relative to the platform 20 of the boat in response to actuating and pivoting the DD ramp 14 about the first end 14*a*. The second end 14*b* therefore may have a variety of positions relative to the platform 20. In a first position (FIG. 2B), the second end 14*b* may be in a stowed and elevated position and disposed adjacent or near the bottom surface 20*b* of the platform. In a second position, the second end 14*b* may be in a lowered position and disposed away from the bottom surface 20*b* of the platform 20 and substantially lower than the first end 14*a*. FIG. 2A illustrates the DD ramp 14 in a stowed position, and FIG. 2B illustrates the DD ramp 14 in a lowered position. It will be appreciated that the DD ramp 14 in the stowed position need not be pivoted fully upward and against the bottom surface 20*b*, but rather may be positioned a sufficient distance so as not to contact the water during operation.

In the first position, which may also be referred to as the stowed position, the DD ramp 14 may not make contact with the water when the boat 12 is floating or travelling. In this position, the boat 12 may operate in a manner resembling a traditional pontoon boat. In the second position, which may be described as an angled position or extended position and which may be deployed at a variety of angles relative to the stowed position, the DD ramp 14 will make contact with the water, thereby displacing and directing an additional volume of water relative to a traditional pontoon boat that is not otherwise displaced.

With the DD ramp 14 being actuatable and moveable between the first position and the second position, it will be appreciated that the DD ramp 14 may have a plurality of intermediate positions between the first position and the second position. For the purposes of the discussion, the second position will be understood to mean the desired, optimum, or target position for enhancing the wake profile characteristic. It will be understood that other positions relative to the second position, including intermediate positions or positions further downward from the second position, may also be used that enhance the wake pattern relative to the first position.

The DD ramp 14 may be actuated by one or more actuator mechanisms 30. The actuator mechanism 30 may be a linear actuator extending between the DD ramp 14 and the platform 20, or between the DD ramp 14 and other supporting structure of the boat 12. It will be appreciated that other types of actuators may also be used that are capable of moving the DD ramp 14 between the first position and the second position. The actuator may be attached to a laterally central portion of the DD ramp 14, and may be attached to a point near the second end 14*b*. However, in another approach, the actuator 30 may be attached to the DD ramp 14 at a lateral edge or at a longitudinally middle portion of the DD ramp 14. In another approach, multiple actuators 30 may be attached to the DD ramp 14.

When the DD ramp 14 is in the second position, the DD ramp 14 will extend downward into the water and will direct the previously unorganized and turbulent water flow between the pontoons 18 in a controlled manner, organizing the water flow and directing it downward and rearward along the DD ramp 14, where the flow may then exit from the end of the DD ramp 14 near the rear of the boat 12. Thus, the DD ramp 14 operates to displace an addition amount of water relative to a traditional pontoon boat, which creates additional drag on the boat 12.

Figure 3:
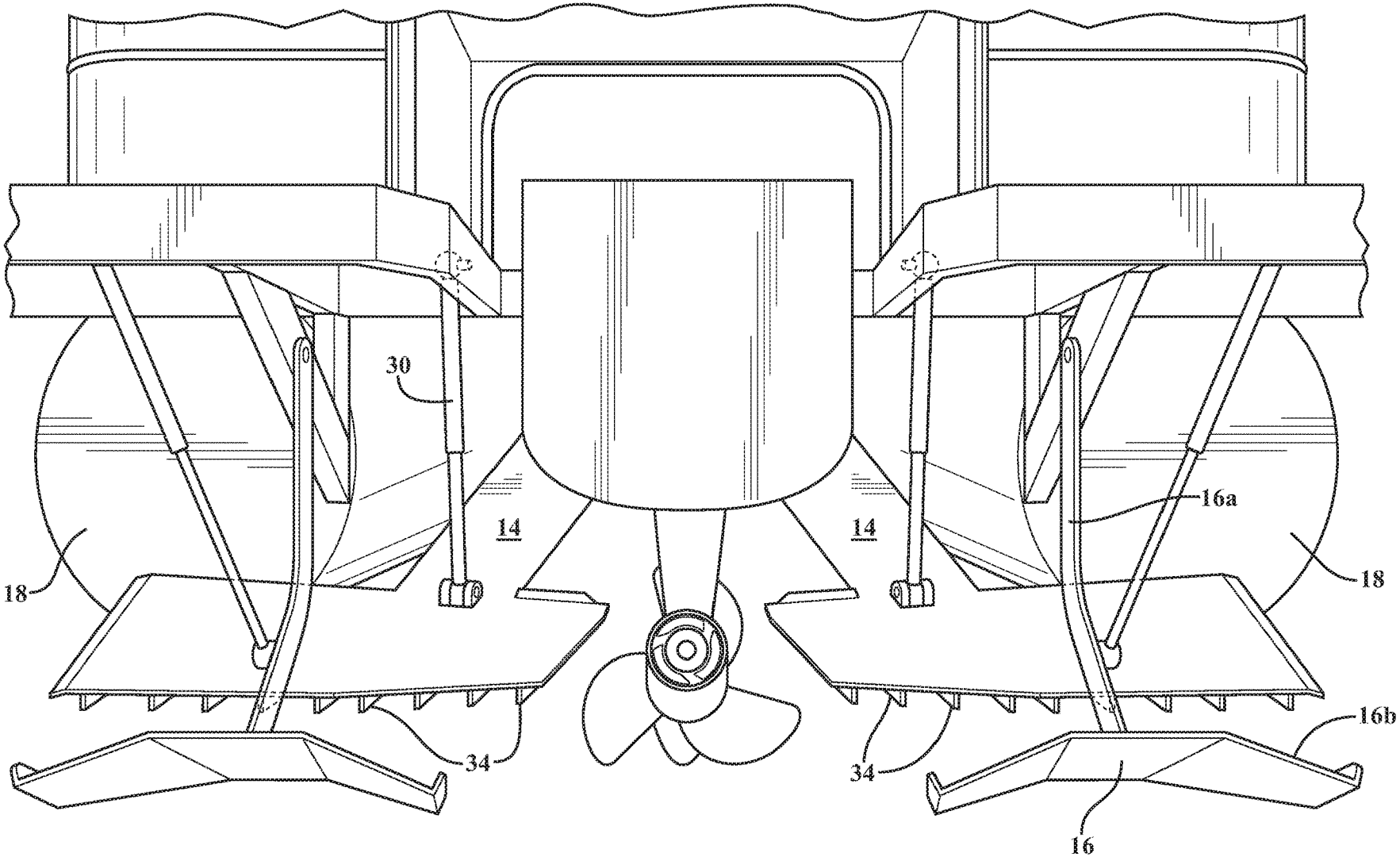
FIG. 3 is a rear view of the boat.
Figure 4:
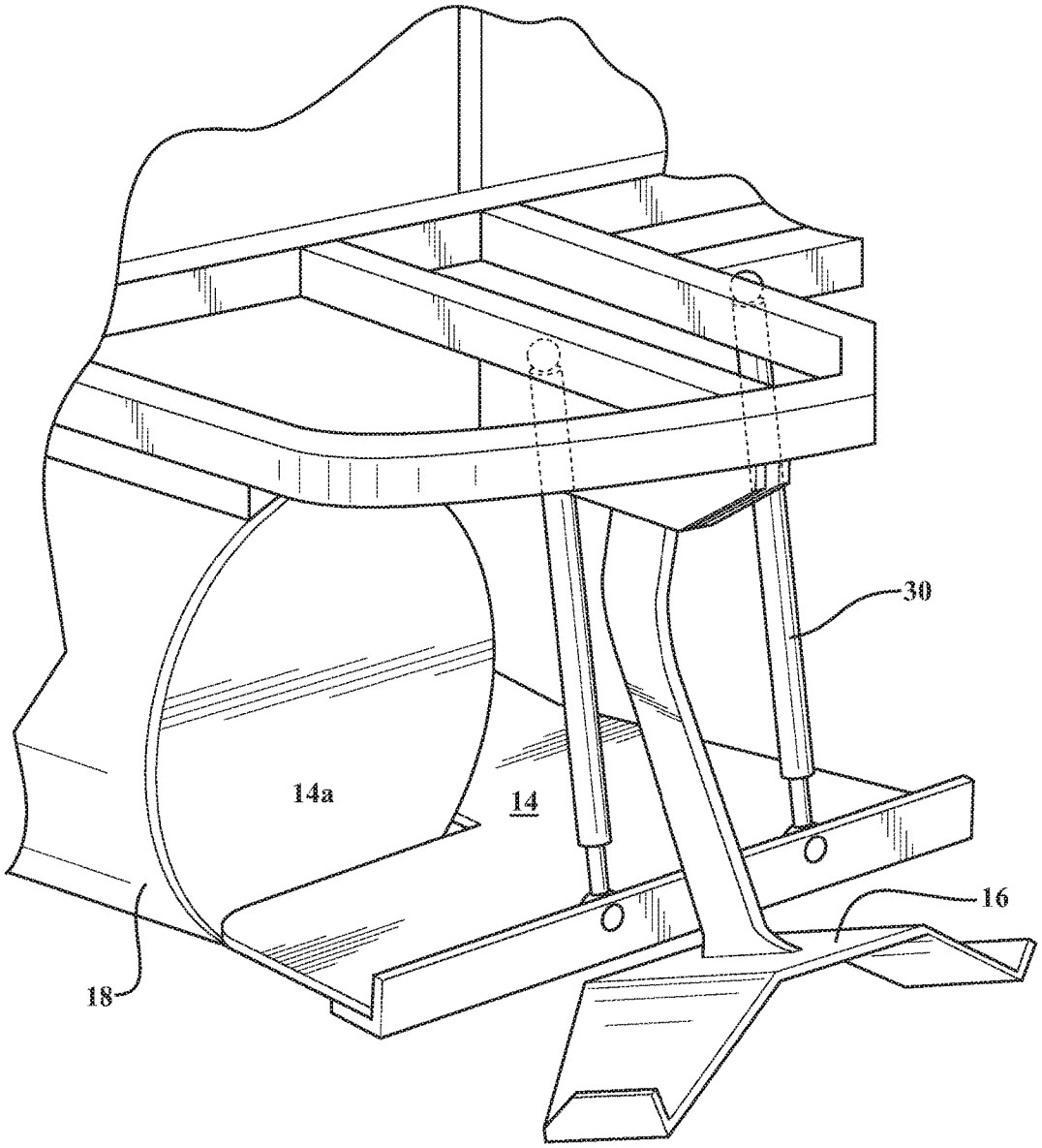
FIG. 4 is a fragmentary perspective view of the ramp and wake plate relative to the end of the pontoon.

The second end 14*b* of the DD ramp 14 may be disposed near the rear of the boat 12, and can be disposed rearward from the ends of the pontoons 18. In one aspect, as shown in FIGS. 3 and 4, the DD ramps 14 terminate rearward from the pontoon 18. The DD ramp 14 may wrap around the end of the pontoon 18. However, in another approach, the DD ramp 14 may not wrap around the end of the pontoon 18, or may terminate a point forward from the end of the pontoon 18, and may still organize and displace the water flowing between the pontoons 18.

The ramps 14 may be attached to the platform 20 at a point that is generally near the longitudinal midpoint of the boat 12, as shown in FIGS. 2A and 2B for the long version of the DD ramp 14. It will be appreciated that the DD ramp 14 does not need to be attached at the exact middle position, of course. In another approach, the ramp may be attached at about ⅓ of way back from the front of the boat, or ⅔ of the way back from the front of the boat, for example in the short version 114 shown in FIG. 2*a*. The location of the attachment may be selected based on the exact boat size and the desirable amount of water to be displaced.

In a preferred form, the DD ramp 14 is attached to a point 40-60% rearward, and when actuated downward, the DD ramp 14 defines a 15-25 degree angle relative to the platform 20. In one approach, the DD ramp 14 is angled 20 degrees relative to the platform 20.

By disposing the DD ramps 14 into the water, and displacing and directing more water, the DD ramps 14 thereby create additional surface area that contacts the water, similar to other boat types that displace water over a greater surface area than a traditional pontoon boat. The increase of surface area (and optional directional vanes or ribs that are further described below) is desirable for creating an enhanced wake pattern behind the boat 12. As described previously, the DD ramps 14 may be individually controlled and actuated, meaning that the DD ramps 14 may be at different angles relative to each other for producing the desired wake characteristic. In addition to the ramps 14, there are other manners of increasing the surface area in contact with the water to provide an enhanced wake pattern. For example, ballast may be added to the boat 12 in different ways, thereby increasing the weight of the boat 12 and increasing the amount that the pontoons 18 extend into the water.

The ramps 14 may have different shapes to further tailor and shape the direction that the water displaced by the ramps 14 will flow. In one approach, shown in FIG. 3, the ramps 14 may have a generally flat configuration along the length, such that each lateral side of the DD ramp 14 is disposed at the same general distance from the platform 20. In another approach, the DD ramp 14 may have a twisted profile, such that an inner or outer lateral side of the second end 14*a* is lower/higher than the opposite lateral side. In one approach, the laterally outboard side is higher than the laterally inboard side, such that flow is directed laterally outward and toward the laterally outward pontoon 18. The DD ramps 14 may be generally flat in the front to rear direction, thereby having a generally constant slope, or the DD ramps 14 may have a curved profile when viewed from the side, with a large radius from front to rear.

In one aspect, as shown in FIG. 6, the ramps 14 may include a plurality of vanes, fins, or ribs 34 that extend downward from a bottom surface defined by the DD ramp 14. The ribs 34 may extend generally longitudinally along the length of the DD ramp 14, and may create a plurality of rib channels 34*a* laterally between the ribs 34. The ribs 34 may be curved at their rearward ends to direct the flow of water travelling along the DD ramp 14 and through the channels 34*a* defined by the ribs 34. The channels 34 may provide an additional degree of control over the flow of the water to ensure that the water flowing along the DD ramp 14 remains displaced and directed toward the rear of the boat 12. The ribs 34 may have a greater effect on boats 12 having two pontoons 18 relative to boats 12 having three pontoons 18. In the case of a boat having three pontoons 18, the central pontoon 18*a* may operate to keep the water flowing along the DD ramp 14.

While the DD ramps 14 have been generally described as having an elongated plate-type structure, it will be appreciated that the ramps 14 may have various edge shapes or trailing shapes that can alter the wake profile, as desired. In one approach, the rear end of the DD ramp may extend between 12-24 inches, and in one aspect approximately 15 inches, from the rear edge of the pontoons 18. The rear end of the DD ramp 14, being extended beyond the end of the pontoons 18, may wrap outwardly around the rear end of the pontoons 18 and define a rear portion 14*a*.

The rear portion 14*a*, due to wrapping around the rear of the pontoon 18, therefore may have a greater lateral width than the portion of the DD ramp 14 that extends longitudinally between the pontoons 18. The end of the DD ramp 14 and the rear portion 14*a* thereof may wrap to the most outboard edge of the pontoons 18. In one form, the DD ramp 14 may extend approximately 12 inches on the inboard side of the pontoon 18 and may extend approximately 14-15 inches on the outboard side of the pontoon 18. Accordingly, the trailing edge of the rear portion 14*a* may be angled when viewed from above. In one approach, the rear portion 14*a* of the DD ramp 14 may be approximately 36 inches wide in the lateral direction. The rear portion 14*a* may also extend laterally inward.

When extended downward, the DD ramp 14 contacts the water and forces the water downward in accordance with the angle of the DD ramp 14. However, the water also provides an upward reaction force on the DD ramp 14. Accordingly, in order to increase the amount of water displacement causes by the DD ramp 14, it is desirable to provide additional downward force on the boat 12. In one aspect, additional downforce may be provided by the wake plate 16.

As shown in FIGS. 1A-4, the wake plate 16 may be attached to the rear of the boat 12 and may extend down into the water during operation. The wake plate 16 may be attached to a rear platform portion 20*c* of the platform 20, such as a diving or egress platform (sometimes referred to as a swim platform) commonly provided on traditional pontoon boats. The wake plate 16 may be fixed in place and may have a generally rigid and fixed shape/construction, such that when installed on the boat the wake plate 16 remains disposed in the water. In an alternative approach, the wake plate 16 may be actuatable to be inserted into and out of the water on demand, similar to the DD ramp 14 being actuatable. FIG. 2B illustrates the wake plate 16 being raised out of the water, and FIG. 2A shows the wake plate 16 in a lowered position for being disposed in the water.

The wake plate 16 may be in the form of a pair disposed on opposite lateral sides of the boat 12. For the purposes of discussion, only one wake plate 16 will be discussed in further detail, unless otherwise noted. In the case of two wake plates 16, they may be symmetrical in overall shape relative to a center axis of the boat 12.

The wake plate 16 may have a T-shape, with a vertically extending post portion 16*a* and a generally laterally extending faceted portion 16*b*. In another approach, multiple post portions 16*a* may be used, such as two post portions 16*a*. The faceted portion 16*b* is disposed at the bottom of the post portion 16*a*, and the faceted portion 16*b* is the portion that is intended to remain within the water during operation. The post portion 16*a* may intersect the faceted portion 16*b* at the approximate center of the faceted portion 16*b* in one approach. However, in an alternative approach, the post portion 16*a* may be offset to one lateral side of the faceted portion 16*b*, and may be attached to a lateral end of the faceted portion 16*b* in some cases (forming an L shape rather than a T shape).

The faceted portion 16*b* may have a generally flat profile, such as a plate or the like. The faceted portion 16*b* may therefore have a rectangular profile. However, the faceted portion 16*b* may have other profile shapes, such as a square, oval, diamond, or other polygonal profile. The faceted portion 16*b* defines a surface area corresponding to the size and shape of the profile, and the surface area acts on the water that flows onto the faceted portion 16*b* during operation.

The post portion 16*a* may also be in the form of a plate, with the thin edge of the plate preferably facing the direction of the water flow, such that the surface area defined by the plate is generally not exposed to the direction of flow, thereby reducing drag produced by the post 16*a*. The post 16*a* may also be in the form of a rod or the like, because the lateral surface area of the post 16*a* is generally insignificant in the operation of the wake plate 16. Indeed, it is preferable to reduce the drag caused by the post 16*a*. The primary function of the post 16*a* is to support the faceted portion 16*b* that is disposed in the water during operation.

In one approach, the post portion 16*a* has a generally fixed length, and may be pivotable relative to its connection to the boat 12 via a hinge or pin mechanism. The post portion 16*a* may be connected to an actuator, which may be a linear actuator, to change the position of the wake plate 16 relative to the boat 12, for instance to lower the wake plate 16 into the water and to raise the wake plate 16 out of the water. In an alternative approach, the post 16*a* may be in the form of a telescoping mechanism with a built in actuator that may raise and lower and the faceted portion 16*b* relative to the water. It will be appreciated that other mechanism for raising and lowering the faceted portion 16*b* may also be used.

The faceted portion 16*b* may be generally flat in the lateral direction, or its lateral tips may be upturned or downturned relative to the middle portion of the faceted portion 16*b*. The faceted portion 16*b* may have tapered or chamfered corners. As shown in the FIGS. 3 and 4, the lateral sides of the faceted portion 16*b* may be angled downward relative to the middle of the faceted portion 16*b*.

The faceted portion 16*b* may be attached to the post portion 16*a* in a variety of manners, such as via welding, bonding, bolts, rivets, or other robust fixing mechanisms. The post 16*a* and faceted portion 16*b* may be coextruded or integrally formed, such as via casting, sintering, molding, or the like.

When deployed in the water, the wake plate 16 may be oriented such that the faceted portion is angled downward (approximately 10-40 degrees) relative to the direction of travel. The downward angle of the faceted portion 16*b* exposes the surface area of the faceted portion 16*b* to the direction of water flow that is exiting from the channels 22 as directed and organized by the DD ramps 14. Accordingly, the wake plate 16 will provide a downforce on the boat 12 via its connection to the boat 12. Put another way, the water impacting the wake plate 16 will force the wake plate 16 downward, which will thereby pull the wake plate 16 down into the water and provide downforce, which pulls the rear of the boat 12 into the water.

In addition to the downforce provided by the wake plate 16, the wake plate 16 further creates a final wake shape characteristic for enhanced surfing and boarding by forcing the water in an upward direction and creating an exit roll form or curl from the wake plate 16.

The downforce provided by the wake plate 16 thereby contributes to the displacement of the water caused by the pontoons 18 and DD ramps 14 and counteracts the reaction force of the water that tends to urge the boat upward out of the water in response to contacting the DD ramps 14.

The wake plate 16 may be oriented at a desirable angle depending on the size and weight of the boat 12 and other aspects affecting the flow and displacement of the water. In one approach, the angle of the wake plate 16 when the boat is oriented horizontally is 30 degrees. However, other angles may also be set.

The wake plate 16 and/or the faceted portion 16*b* thereof may be actuatable to adjust the angle of orientation depending on feedback or other inputs affecting the water flow to provide a desirable efficiency and downforce. Sensors may be placed on the wake plate 16 to detect the forces or water flow rates being applied to the wake plate 16 for this purpose.

In addition to the actuator for adjusting the height of the wake plate 16, the wake plate 16 may also be actuated or adjusted manually. For example, the post 16*a* may be pivotable relative to its connection to the boat 12, and the post 16*a* may then be fixed when the wake plate 16 is angled in the desired location. A plurality of mounting holes or passthroughs may be provided on a flange or similar structure, with a pin or screw inserted into the flange to hold the wake plate in the desired orientation relative to a fixed bracket.

Thus, with the wake plate 16 disposed in the water and angled downward, and located in the path of the water that is organized and displaced by the DD ramp 14, the wake plate 16 will provide a substantial downforce on the boat 12, increasing the water displacement and thereby increasing the height of the wake produced and enhancing the wake profile characteristic. As a result of the downforce that is produced by the water flow impacting the wake plate 16, the water is also directed upward by the wake plate 16 and toward the surface. By directing the water upward, the height of the wake may increase.

The wake plate 16 has been described herein as being attached to the rear platform 20*c* or otherwise being a separate structure relative to the DD ramp 14, but the wake plate 16 may alternatively be attached to the DD ramp 14.

With reference to FIG. 5, in this approach, the wake plate 16 may be attached to the rear end of the DD ramp 14 and will be disposed rearward from the ramp 14, similar to the positional arrangement described above. In this approach, the wake plate 16 will move up and down in accordance with the movement of the DD ramp 14 between the stowed position and the angled position. The wake plate 16 may be attached to the end of the DD ramp 14 via a plurality of gussets 17. In one form, three gussets 17 are disposed between the DD ramp 14 and the wake plate 16.

The gussets 17 may have a plate-type structure and extend generally longitudinally between the DD ramp 14 and the wake plate 16. The wake plate 16 remains spaced away from the end of the DD ramp 14, such that water flowing past the end of the ramp 14 may impact the upper front surface of the wake plate 16 and provide the necessary downforce. In one approach, when the DD ramp 14 is disposed at a 20 degree angle from the platform 20, the wake plate 16 is disposed at an opposite 30 degree angle. Accordingly, the wake plate 16 and DD ramp 14 may be disposed at 120 degrees relative to each other.

The actuators 30 described above, in this approach, can be attached to the gussets 17, and in particular, the laterally outmost gussets 17, to raise and lower both the ramp 14 and the wake plate 16 together. Of course, it will be appreciated that the actuator 30 or actuators 30 could be attached to the middle gusset 17, to the DD ramp 14, or to the wake plate 16, and may still raise and lower the DD ramp 14 and wake plate 16 together.

In addition to providing the wake plates 16 at the rear of the boat 12, additional wake plates 16 may be disposed under the platform 20 of the boat 12 at a middle portion of the boat 12, such as near the longitudinal center of the boat 12. It will be appreciated that the wake plates 16 in this location need not be at the exact center of the boat 12, and can be located forward or rearward from the center. The additional wake plates may provide an additional downforce on the boat 12, thereby increasing the displacement of the water and further altering the wake profile.

The system 10 may include further components to alter the wake profile and water displacement and direction, which may be used along with the DD ramps 14 and/or wake plates 16. In one approach, shown in FIG. 10, the pontoons 18 may include a rear portion 40 that has a different profile relative the traditional blunt ends at the rear of traditional pontoon shapes. The rear portion 40 may be an additional component or module that may be welded or otherwise secured to the rear end of an existing pontoon 18, or it may be shaped as part of the overall pontoon 18 during initial construction.

Figure 10:
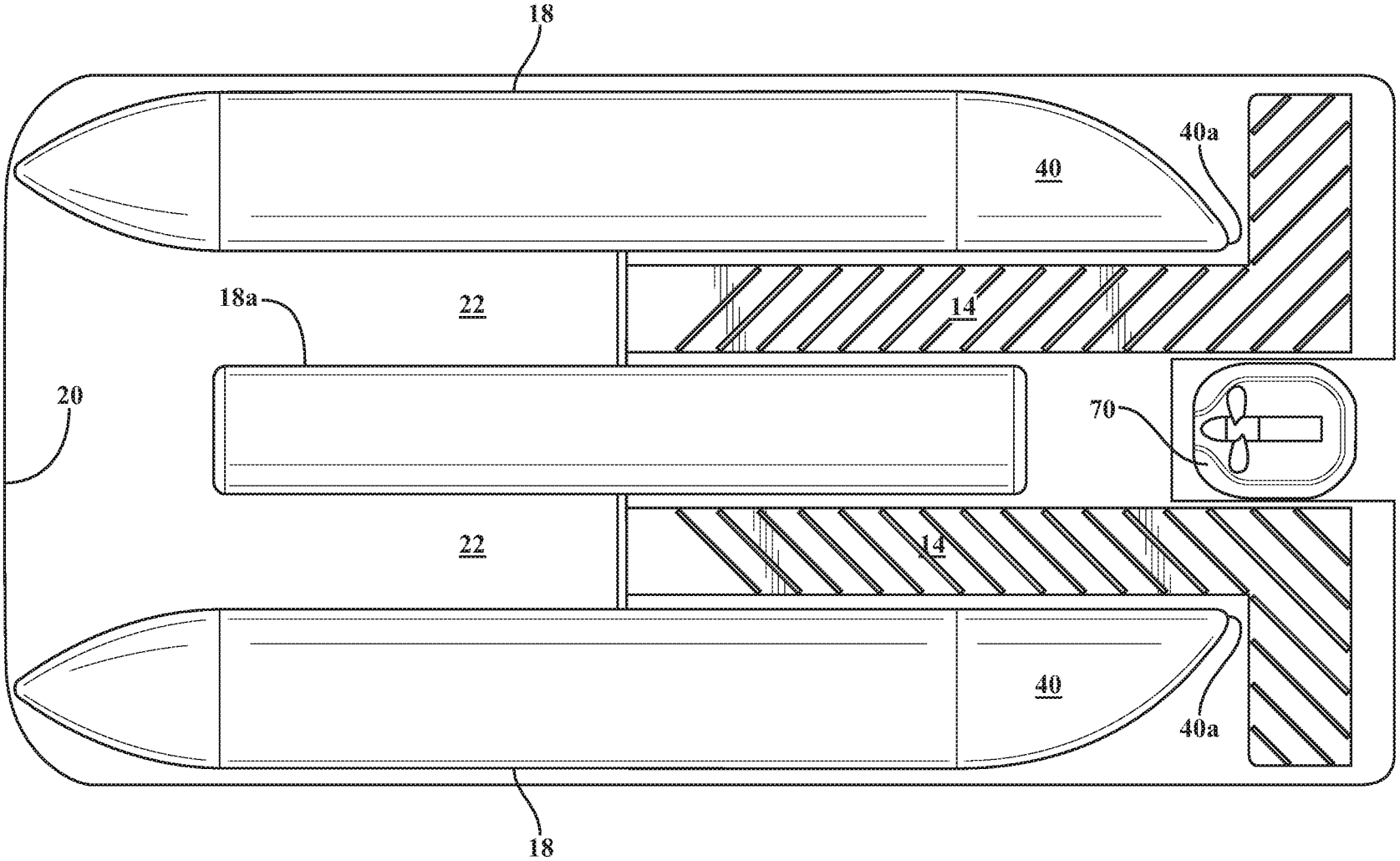
FIG. 10 is a bottom view of another aspect of the boat illustrating a contoured trailing end for the pontoons.

The rear portion 40 may include a rear tip 40*a* that is generally disposed at the rear-most end of the rear portion 40. The rear portion 40 will taper down toward the tip from a wider shape that will typically correspond to the profile of the pontoon 18. In one approach, the rear tip 40*a* is disposed at an inboard side of the pontoon, as shown in FIG. 10, such that an outer side of the pontoon 18 will taper down toward the tip 40*a*, while the inboard side of the rear portion 40 may remain generally aligned with the inboard side of the pontoon 18. The outboard side of the rear portion 40 may taper down in curved manner having various possible curved profiles. In another approach, the outboard side may taper down at a generally constant slope, similar to a conical shape.

In another approach, the rear tip 40*a* may be disposed at a laterally middle portion of the rear portion 40, such that both the inboard and outboard sides of the rear portion 40 taper down toward the rear tip 40*a*. The outboard and in board portion may have a taper that is the same size and shape, or they may taper at different profiles. The rear tip 40*a* may be disposed at the lateral center of the pontoon 18, or the rear tip 40*a* may be offset from the center.

The lateral side of the pontoon 18 to which the rear tip 40*a* is offset will control the direction in which water is directed around the rear portion 40 of the pontoon 18. In one approach, with the rear tip 40*a* shifted inward relative to the center of the pontoon 18, the water flowing on the outboard side of the pontoon 18 will thereby be directed inwardly as it flows along the tapered outer side of the rear portion 40. This inwardly directed water that is displaced by the pontoon 18 may therefore combine with the water that is displaced on the inboard side of the pontoon 18, such as the water that is displaced by the DD ramp 14, resulting in a further modified wake profile trailing the boat 12.

It will be appreciated that various shapes and profiles of the rear portion 40 may be used to alter the direction of flow of the water displaced by the pontoon 18. In one form, the rear portion 40 may be attached to the pontoon 18 such that it may be actuated (by an actuator or manually) and rotated relative to the pontoon 18 to change the position of the rear tip 40*a* relative to the pontoon 18.

Figure 8A:
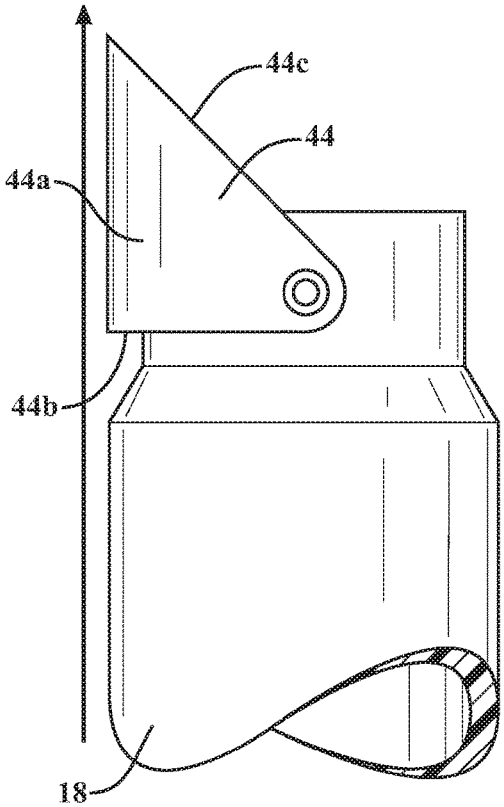
FIGS. 8A-8C illustrate an aft scoop mechanism at the rear end of the pontoon.
Figure 8B:
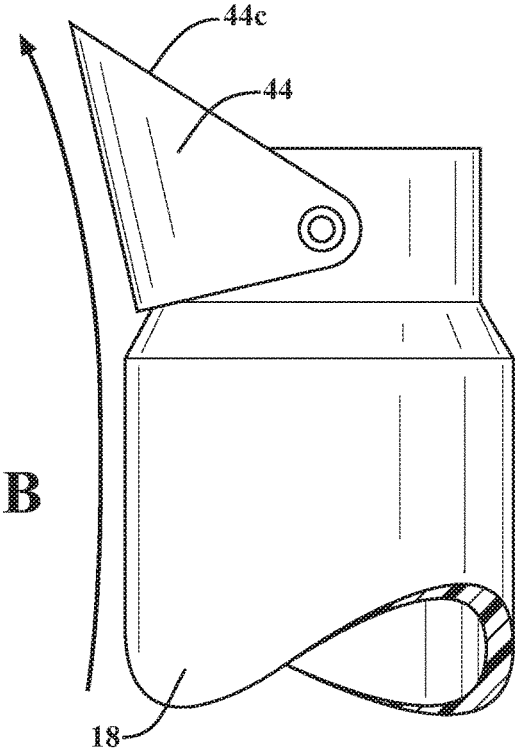
Figure 8C:
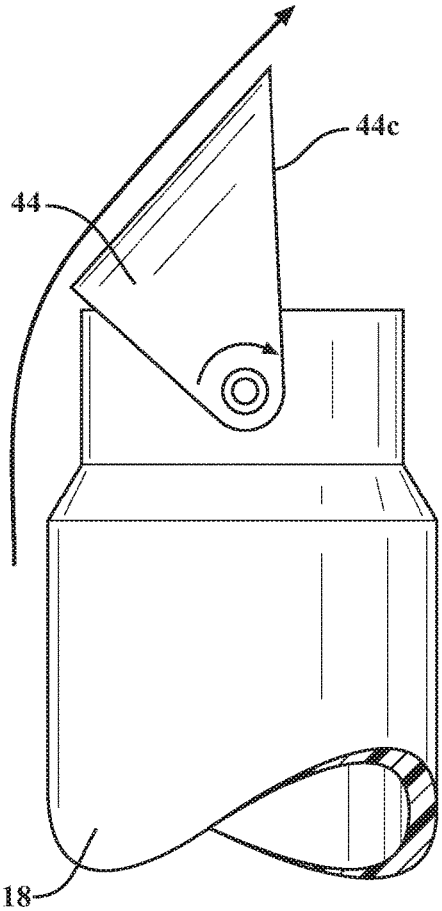

With reference to FIGS. 8A-8C, in one aspect, an adjustable rear scoop 44 may be provided and pivotably attached to the rear end of the pontoons 18. The rear scoop 44 may function to provide a preferred water path by increasing the length of the water path or as wake enhancement mechanism. The scoop 44 may have an upper end and a lower end, and may have a semi-circular or curved profile when viewed from the rear. The upper end and lower may be attached to an upper portion and a lower portion, respectively, or the rear end of the pontoon 18.

The body of the scoop may be disposed on the outboard side of the pontoon 18, and may pivot about a generally vertical axis disposed at a center of the rear end of the pontoon 18. Thus, the scoop 44 may be disposed on the outboard half of the pontoon 18. The body of the scoop 44 may be in the form of a sidewall 44*a* having a partial cylinder shape. The scoop 18 may have a leading edge 44*b* that corresponds to a "half-tube" or "half-cylinder" shape, and may therefore define an approximate semi-circle. The scoop 44 may include a trailing edge 44*c* having a partial elliptical cross-sectional shape, such as that of a half-cylinder with a transverse cut at an oblique angle. Accordingly, the body of the scoop 44 may have a curved outer surface with a curved perimeter that reduces in a rearward direction.

The scoop 44 may have a neutral position, an inwardly canted position, and an outwardly canted position, each shown in FIGS. 8A-8C. In the neutral position, the outer surface of the scoop 44 may extend generally parallel to the outboard side of the pontoon 18, and the leading edge may be effectively perpendicular to the longitudinal axis of the pontoon 18. A tapered portion of the pontoon 18 may extend to a reduced diameter portion of the pontoon 18, around which the scoop 44 is positioned, such that the outer surface of the scoop 44 will generally align with the outer surface of the pontoon 18 when in the neutral position.

In the inwardly canted position (FIG. 8C), the scoop 44 may pivot about its attachment to the pontoon 18, such that the trailing edge 44*c* of the scoop 44 is positioned inwardly relative to the neutral position. Thus, the curved outer surface extends at an inward angle relative to the outer surface of the pontoon 18.

In the outwardly canted direction (FIG. 8B), the scoop 44 is pivoted in the opposite direction relative to the neutral position, such that the trailing edge 44*c* is disposed outwardly relative to the neutral position. Thus, the curved outer surface of the scoop 44 extends at an outward angle relative to the longitudinal axis of the pontoon 18.

With the scoop 44 in a neutral position, the scoop 44 may function as an extension of the outboard side of the pontoon 18. With the scoop 44 in the inward position, the scoop 44 will direct water flowing on the outboard side of the pontoon 18 inwardly, thereby increasing the wake energy, similar to the offset rear portion 40 of the pontoon 18 described above. With the scoop 44 in the outward position, the scoop 44 will direct the water flowing on the outboard side of the pontoon 18 further outward, therefore increasing the length of the water path, interrupting the symmetry of the water flow of the boat 12 and providing a desired wake characteristic.

In one approach, the scoop 44 on one side of the boat 12 may be canted outwardly while the scoop 44 on the opposite side of the boat 12 may be canted inwardly. The result of this arrangement causes the wake energy to be enhanced on the side of the boat 12 where the scoop 44 is canted inwardly, and the length of the water path is increased on the opposite side, thereby increasing the length of the path of the water on the outwardly canted side. Thus, the wake profile may be better enhanced on a selected side (the side that is inwardly canted) to account for differing styles and preferences of the wakeboarder or wakesurfer. The scoops 44 on each side can then be switched to enhance the wake on the other side if preferred by a subsequent wakeboarder or wakesurfer.

Thus, the rear or aft scoop 44 allows for adjusting the wake profile dependent on the position of the scoop 44 to create different wake profiles depending on the needs of the user. The scoop 44 may be actuatable via a linear actuator or other controllable actuation mechanism, and may be controlled by an onboard controller via closed-loop control with feedback or open-loop control. The scoop 44 may also be actuated or positioned manually. The scoop 44 may be fixable in a desirable position for repeated use, if desired.

In another aspect, shown in FIGS. 7A-7C, similar to the scoops 44 and the functionality thereof to enhance a desired side of the wake profile, an actuatable flap 46 may be disposed on the outboard sides of the outer pontoons 18. The flap 46 may have a stowed position and an extended position and a plurality of positions therebetween.

The flap 46 may have a generally triangular profile when viewed from the side of the boat 12, where the front end of the flap is narrower than the rear end. The flap 46 may pivot about a pivot point or hinge disposed near the front end, and may be actuated by an actuator disposed about 75% rearward from the front end.

When stowed, the flap 46 may be generally continuous with the outboard surface of the pontoon 18, and effectively replaces the outboard surface in the area in which the flap overlaps the pontoon 18. The flap 46 may be generally flat along its length, in contrast to the curved outer surface of the pontoon 18. Thus, the due to the flat triangular shape of the flap 46, the flap 46 will extend inwardly relative to the curved outer surface of the pontoon 18, as shown in FIG. 7C). Thus, when stowed, the flap 46 will function similarly to the inwardly canted scoop 46, and will direct water flowing along the outboard surface inwardly, and may provide similar wake enhancement functionality at this side of the boat 12.

When actuated to the extended position, the flap 46 is canted outwardly, and will provide the increased water path length functionality, creating a longer path for the water flowing along the outboard side and along the extended flap 46.

Thus, to enhance the wake on a desired side of the boat 12, one of the flaps 46 may be actuated and extended outwardly from the stowed position, while the opposite flap 46 may remain stowed. The water on the stowed side will flow inwardly and enhance the wake profile on that side, and the water on the opposite extended side will be forced outwardly and will increase the water path length on that side. To switch the side where wake is enhanced, the extended flap 46 may be stowed, and the stowed flap 46 may be extended.

When wake enhancement or an increased water path length is not desired, both flaps 46 may be stowed to define a generally continuous outer surface of the pontoon 18. In this arrangement, the water be directed inwardly based on the inwardly surface of the stowed flaps 46. With the water being inwardly directed on both sides, the wake may effectively cancel itself out at the rear of the boat 12.

The actuation mechanism and related structure, such as the hinge or other mounting brackets, may be disposed within a pocket 46*a* or similar structure formed on the inside of the pontoon 18. The pocket 46*a* may be sized and shaped to a degree sufficient to make the flap 46 flush with the outer surface of the pontoon 18, and large enough to hold actuation mechanisms or the like.

In one example, the flap 46 may be about 4 feet in length, with the front end being about 4 inches wide and the rear end being about 14 inches wide. The flap 46 may be pivotable between 0 and about 60 degrees.

The scoops 44 and flaps 46 may also be referred to as laterally outboard wake adjustment mechanisms. Both the scoops 44 and the flaps 46 operate to adjust either by directing the water flowing on the outboard side of the pontoons 18 inwardly or outwardly.

Figure 1B:
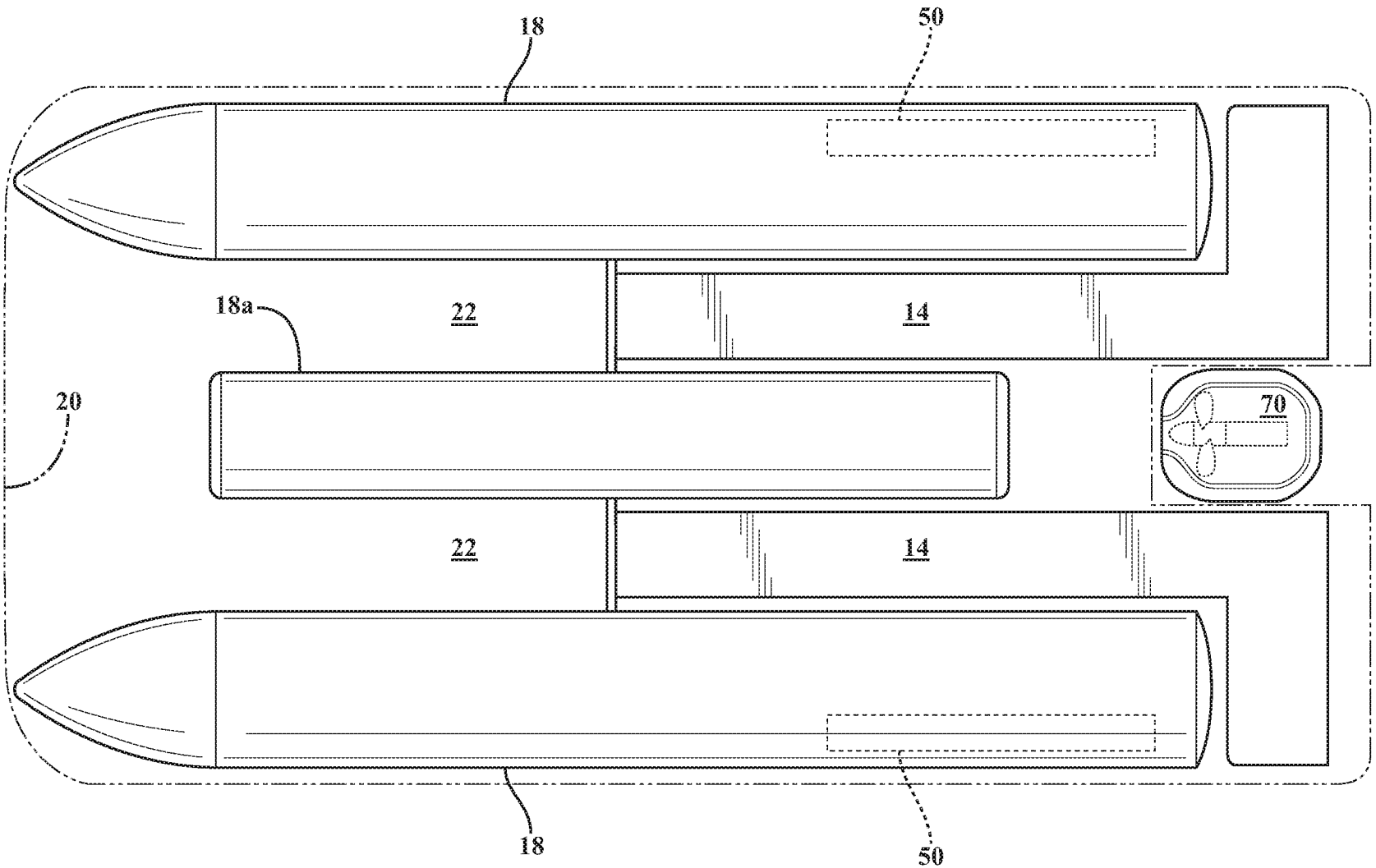
FIG. 1B is a plan view of the boat.

In yet another aspect, as shown in FIG. 1B, the system 10 may include ballast mechanisms 50 disposed at various locations of the boat 12 to selectively increase the weight at specific locations of the boat 12 in order to increase water displacement, as desired. Ballast may be in the form of soft bags or hard tanks that may be filled with ballast material as desired. The ballast mechanism 50 may be disposed internally within the pontoons 18, with an access panel or the like provided in the top of the pontoon 18 to add or remove ballast material from the ballast mechanism 50. Alternatively, the ballast mechanism 50 may be disposed at an external location relative to the pontoon 18. For example, the ballast mechanism may be disposed on an inboard or outboard surface of the pontoon 18, preferably at a location above the expected water level to prevent undesirable drag. The ballast mechanism 50 may be disposed below the platform 20, or the ballast mechanism 50 may be disposed above the platform 20.

The ballast mechanism 50 may be disposed at different locations on the boat 12. For example, the ballast mechanism 50 may be disposed at both rear and middle locations of the boat 12 and on both lateral sides of the boat 12. Typically, the ballast mechanism 50 may not be disposed near the front of the boat 12.

The degree or amount of ballast material used in the ballast mechanism 50, and at which location on the boat 12, may depend on the particular boat size and expected use conditions. Accordingly, the ballast mechanisms 50 may be used to specifically tailor the boat 12 for ideal usage conditions depending on the needs of the user. In one case, it may be desirable for no ballast to be used, while in another, it may be desirable for ballast to be used at both front and rear locations and on both sides. In another case, ballast may only be desirable on one side of the boat 12. It will be appreciated that various combinations of amount and location of ballast may be used. The location and amount of ballast may depend on the number of expected passengers, or the side of the wake profile where the wake surfer or wake boarder prefers to perform. The use of the ballast 50 may in some cases be sufficient to provide the necessary downforce to counteract the upward reaction on the DD ramps 14, such that the wake plates 16 may not be used.

Many of the above-described components of the system 10 include the ability to be actuated by an associated actuation mechanism. The system 10 may include a controller 60 (FIGS. 1A and 2A) including a computing device and associated hardware and software for controlling the above-described actuatable components. The controller 60 may be disposed on the boat 12 where access by the operator during operation of the boat 12 is possible, such as near the traditional boat controls or integrated into the boat control system. The controller 60 may communicate with the actuators to position the components in a desired position, and may receive feedback from the components or the associated actuators to control the position of the components.

The motor and propeller used for propelling the boat 12 may be a traditional motor and propeller commonly used for pontoon boats 12 or other boat types, such as inboard drives or outboard drives with a rear mounted propeller, or an inboard/outboard (stern) drive may be used. The propeller on an outboard or inboard/outboard drive may be pivoted up out of the water when not in use.

Figure 9:
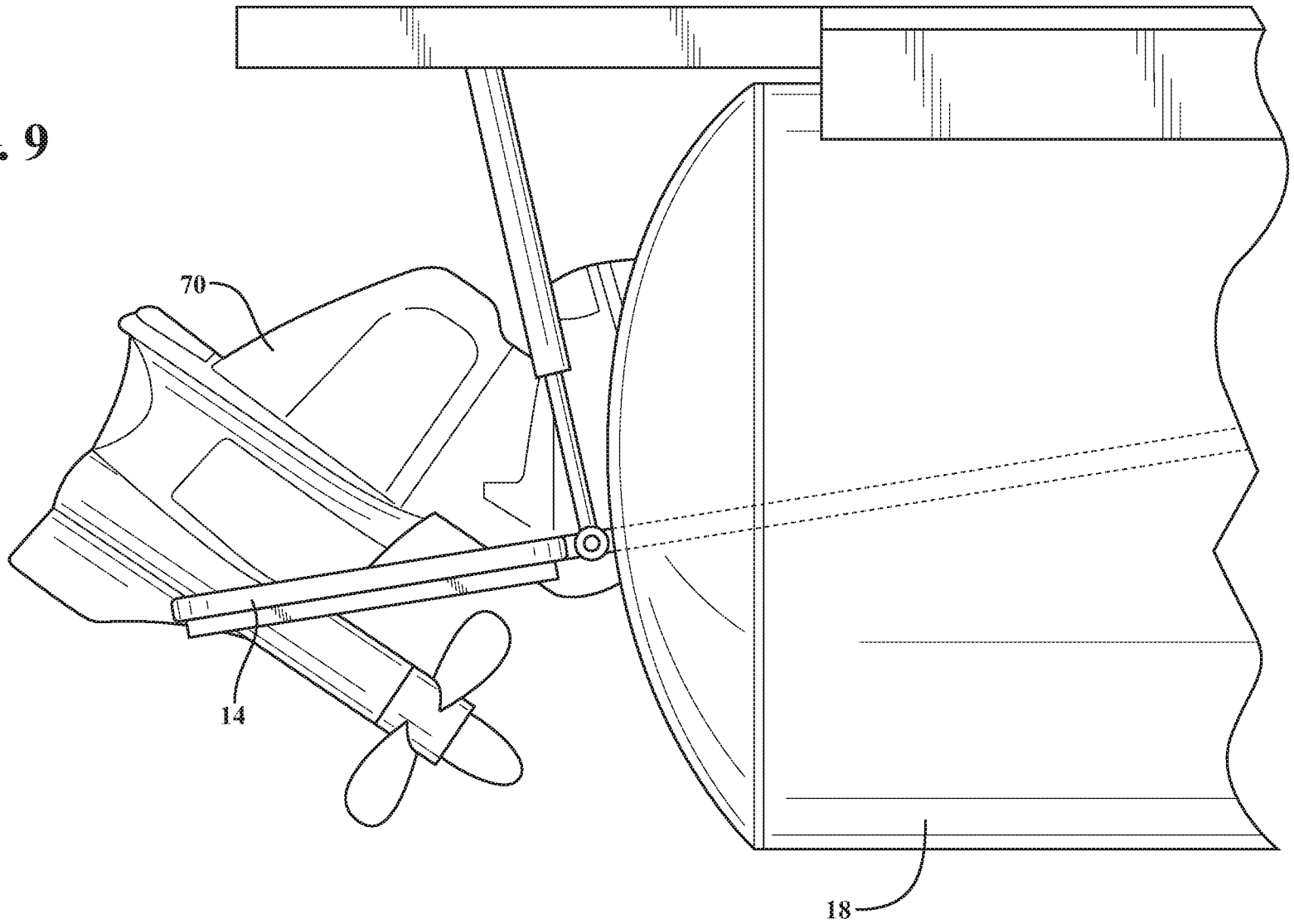
FIG. 9 illustrates a side view of the ramp disposed behind the pontoon and a downwardly angled motor and propeller.

In one aspect, shown in FIG. 9, an inboard/outboard drive 70 may be used with a front mounted propeller. In this approach, the front-mounted propeller when in use may be disposed below the water level and directed in a forward and downward direction. Thus, the propeller itself may provide a substantial degree of downforce at the rear of the boat 12. Accordingly, wake plates may be excluded from the system, with the DD ramps 14 organizing and directing the wake, and the downforce provided by the drive 70.

Thus, in view of the above, the system 10 may be installed on the boat 12 in the manner described above to provide the above-described benefits of increased water displacement and control of the wake produced by the boat 12 to alter the wake profile and create a more surfable wake profile. The above-described components may be used in combination with one or more of the other components affecting the wake profile. For example, the DD ramps 14 may be used in combination with the wake plate system. The contoured rear portion 40, the scoops 44, or the flaps 46 may also optionally be used to direct water inwardly or outwardly to enhance the wake of increase the water path length. Similarly, the ballast mechanisms 50 may be used, with or without the contoured rear portion. The fins or ribs 34 may be included on the DD ramps 14 to direct the water, if desired. In yet another approach, the DD ramps 14 may be used without the wake plates 16, and downforce may be provided by the ballast mechanisms 50 or drive 70. It will be appreciated that various combinations of the above-described components may be used to achieve the desired result of an improved wake profile.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A wake enhancement system for a pontoon boat, the system comprising:

a pair of ramps, including a first ramp and a second ramp, each ramp being moveable between a first position and a second position, the ramps having a ramp body extending between a front end and a rear end, wherein the ramps are configured to provide directional ducting;

wherein, in the first position, the ramp body extends at a first angle relative to a horizontal direction;

wherein, in the second position, the ramp body extends at a second angle relative to the horizontal direction, wherein the second angle is greater than the first angle and the rear end is below the front end;

a wake plate associated with each of the ramps and disposed rearwardly relative to each of the ramps in a first position of the wake plate;

wherein the wake plate includes a faceted portion having an upper surface and a lower surface extending between a front edge and a rear edge and defining an angle of inclination of the wake plate;

wherein, in the first position of the wake plate, the front edge is disposed below the rear edge and the front surface faces forward and upward;

wherein the ramps are configured to displace water downward when the ramps are in the second position; and wherein the wake plate is configured to provide a downforce and wake curl when the wake plate is in the first position.

2. The system of claim 1, wherein the ramps are configured to pivot about a pivot point disposed near the front end of the ramp.

3. The system of claim 1, wherein the first and second ramps are independently pivotable between the first and second position relative to each other.

4. The system of claim 1, wherein the wake plate is moveable between the first position and a second position, wherein the faceted portion is disposed at a higher location in the second position relative to the first position of the wake plate.

5. The system of claim 1, wherein the ramps are actuatable between the first and second positions via respectively associated actuators.

6. The system of claim 5 further comprising a controller operatively coupled to the ramps and configured to move the ramps between the first and second positions.

7. The system of claim 1, further comprising ribs extending along a bottom surface of the ramp body for enhancing directional ducting provided by the ramp.

8. The system of claim 1, wherein the ramps include a rear portion disposed at the rear end of the ramp body, wherein the rear portion extends laterally outward relative to the ramp body.

9. The system of claim 1, wherein the ramp body is generally flat.

10. The system of claim 1, further comprising a pair of laterally outboard wake adjustment mechanisms disposed on laterally opposite outboard sides of the ramps and adjustable between an inwardly canted position and an outwardly canted position, wherein in the inwardly canted position the outboard wake adjustment mechanism directs water flow toward the ramps and enhances the wake profile, and in the outwardly canted position the outboard wake adjustment mechanism directs water away from the ramps and increases the length of a water flow path.

11. The system of claim 1, wherein, for each ramp, the wake plate is fixed to the ramp and moves along with the ramp.

12. The system of claim 1, wherein, for each ramp, the wake plate is spaced away from the ramp and defines an open space therebetween and the wake plate is connected to the ramp via a plurality of gussets.

13. The system of claim 1, wherein, for each ramp, the wake plate is separate from the ramp and independently positioned relative to the ramp.

14. A pontoon boat having enhanced wake-creating ability, the boat including;

at least two pontoons extending in a longitudinal direction;

at least one platform attached to and supported by the pontoons, the platform having a front end and a rear end;

a pair of ramps having a ramp body with a first end pivotably attached to the platform and a second end moveable between a first position and a second position, wherein the second position is below the first position;

a motor having a front mounted propeller and positionable in a downward direction, wherein the motor provides a downforce on the boat when the propeller is angled in the downward direction;

wherein the first end of the ramp body is disposed at a middle portion of the platform between the first and second ends thereof, and the second end of the ramp body is disposed below a rear portion of the platform;

wherein, in the second position, water flowing inboard of the pontoons is displaced downward by the ramps.

15. The boat of claim 14 further comprising, for each of the ramps, a wake plate having a front end and a rear end, wherein the wake plate is disposed rearward relative to the ramps, and the front end of the wake plate is disposed below the rear end of the wake plate in a lowered position and configured to provide a downforce in the lowered position.

16. The boat of claim 14, wherein each ramp includes a rear portion extending laterally from the rear end of the ramp body, wherein the rear portion extends across a rear end of the pontoons toward an outboard surface of the pontoons.

17. The boat of claim 15, wherein each wake plate is fixed to each ramp and moves along with the ramps.

18. The boat of claim 15, wherein the ramps are moveable relative to the wake plates.

19. The boat of claim 14, further comprising a pair of outboard flaps disposed on an outboard surface of an associated pontoon, wherein the flaps are pivotable between a stowed position against the associated pontoon and an extended position away from the associated pontoon, wherein in the stowed position the flaps are canted inwardly relative to the outboard surface of the associated pontoon and in the extended position the flaps are canted outwardly relative to the outboard surface of the associated pontoon.

20. The boat of claim 14 further comprising a pair of aft scoops disposed on a rear end of an associated pontoon, wherein the aft scoops are pivotable between an outwardly canted position and an inwardly canted position relative to the associated pontoon.

21. A method of enhancing a wake pattern produced by a pontoon boat, the method including the steps of:

conveying a pontoon boat in a forward direction, the pontoon boat having at least two pontoons, including a first pontoon and a second pontoon, the pontoons supporting a platform and defining a first wake profile;

displacing water into an area between the at least two pontoons and defining a displaced water flow;

positioning a pair of ramps, including a first ramp and a second ramp, at an oblique angle relative to the platform;

positioning the ramps into the displaced water flow and directing the displaced water flow downward;

providing a downforce on the pontoon boat to counteract an upward force received by the ramps; and defining a second wake profile in response to positioning the ramps at an oblique angle, wherein the second wake profile is higher than the first wake profile.

22. The method of claim 21 further comprising positioning a wake plate behind the ramps, wherein the wake plate has a front end and a rear end and the front end is disposed below the rear end.

23. The method of claim 21, further comprising directing water at an outboard surface of the first pontoon outwardly and directing water at an outboard surface of the second pontoon inwardly.

24. The method of claim 21, wherein the first ramp and the second ramp are positioned at different oblique angles relative to each other.

25. The method of claim 21, wherein the downforce is provided by a downwardly directed motor and propeller.

26. A pontoon boat with wake-enhancing features, comprising:

at least two laterally spaced pontoons and a deck supported by said pontoons;

at least one wake enhancement device supported for selective downward deployment for deflecting water to alter the size and/or shape of the wake of the pontoon boat when downwardly deployed; and a propulsion system separate from the wake enhancement device having a front mounted propeller; wherein front mounted propeller is positionable in a downward direction, wherein the propulsion system provides a downforce on the boat when the propeller is angled in the downward direction.

27. The pontoon boat of claim 26, wherein the wake enhancement device is an actuatable plate.

28. The pontoon boat of claim 27, wherein at least a portion of the actuatable plate is disposed longitudinally behind at least one of the laterally spaced pontoons.

29. The pontoon boat of claim 28, wherein a rear end of the actuatable plate is disposed below a front end of the actuatable plate when downwardly deployed.

30. The pontoon boat of claim 26, wherein the at least one wake enhancement device alters the size and/or shape of the wake without added ballast.

31. The pontoon boat of claim 26, wherein the at least one wake enhancement device generates an upward reaction force from the deflected water that is countered by the downforce provided by the propulsion device when the propulsion device is directed downward.

* * * * *